US007520773B2

(12) United States Patent
Siebens et al.

(10) Patent No.: US 7,520,773 B2
(45) Date of Patent: Apr. 21, 2009

(54) FLAP SEATING INDICATOR

(75) Inventors: Larry Norman Siebens, Ashbury, NJ (US); Anthony Reed, Murray, NJ (US); Roger Provencal, Washington, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/008,050

(22) Filed: Jan. 8, 2008

(65) Prior Publication Data

US 2008/0166911 A1 Jul. 10, 2008

Related U.S. Application Data

(60) Provisional application No. 60/879,298, filed on Jan. 8, 2007.

(51) Int. Cl.
*H01R 3/00* (2006.01)

(52) U.S. Cl. ..... 439/488

(58) Field of Classification Search ..... 439/488–491, 439/921, 181–187, 680
See application file for complete search history.

(56) References Cited

U.S. PATENT DOCUMENTS

| | | | | |
|---|---|---|---|---|
| 4,793,637 | A | 12/1988 | Laipply et al. | |
| 5,641,306 | A | 6/1997 | Stepniak | |
| 5,795,180 | A | 8/1998 | Siebens | |
| 5,957,712 | A | 9/1999 | Stepniak | |
| 6,168,447 | B1 | 1/2001 | Stepniak et al. | |
| 6,213,799 | B1 | 4/2001 | Jazowski et al. | |
| 6,504,103 | B1 | 1/2003 | Meyer et al. | |
| 6,585,531 | B1 | 7/2003 | Stepniak et al. | |
| 6,830,475 | B2 | 12/2004 | Jazowski et al. | |
| 6,843,685 | B1 | 1/2005 | Borgstrom et al. | |
| 6,939,151 | B2 | 9/2005 | Borgstrom et al. | |
| 6,984,791 | B1 | 1/2006 | Meyer et al. | |
| 7,044,760 | B2 | 5/2006 | Borgstrom et al. | |
| 7,044,769 | B2 * | 5/2006 | Zhao et al. | 439/489 |
| 7,083,450 | B1 | 8/2006 | Hughes | |
| 7,150,098 | B2 | 12/2006 | Borgstrom et al. | |
| 7,216,426 | B2 | 5/2007 | Borgstrom et al. | |
| 7,258,585 | B2 | 8/2007 | Hughes et al. | |
| 7,288,718 | B2 | 10/2007 | Stepniak et al. | |
| 2008/0166913 | A1 * | 7/2008 | Siebens et al. | 439/489 |

OTHER PUBLICATIONS

"Loadbreak Apparatus Connectors 500-26," © Cooper Power Systems, Inc., Jan. 1997.
"Loadbreak Apparatus Connectors 5500-12-1," © Cooper Power Systems, Inc., Aug. 1994.

* cited by examiner

*Primary Examiner*—Edwin A. Leon
(74) *Attorney, Agent, or Firm*—Hoffmann & Baron, LLP

(57) ABSTRACT

A flap seating indicator for loadbreak and deadbreak connectors that include a substantially round ring-shaped body and a plurality of flaps located around the circumference of the body and extending from one of the side edges. Each of the plurality of flaps has a first section that attaches to the body and is pivotably connected to a second section that has an indicating surface. The seating indicator is attached to an inner surface of an elbow cuff lip on an elbow connector. When a bushing insert is properly inserted into the elbow connector, the second section of each of the plurality of flaps pivots so that the indicating surfaces of the flaps face the elbow connector.

13 Claims, 7 Drawing Sheets

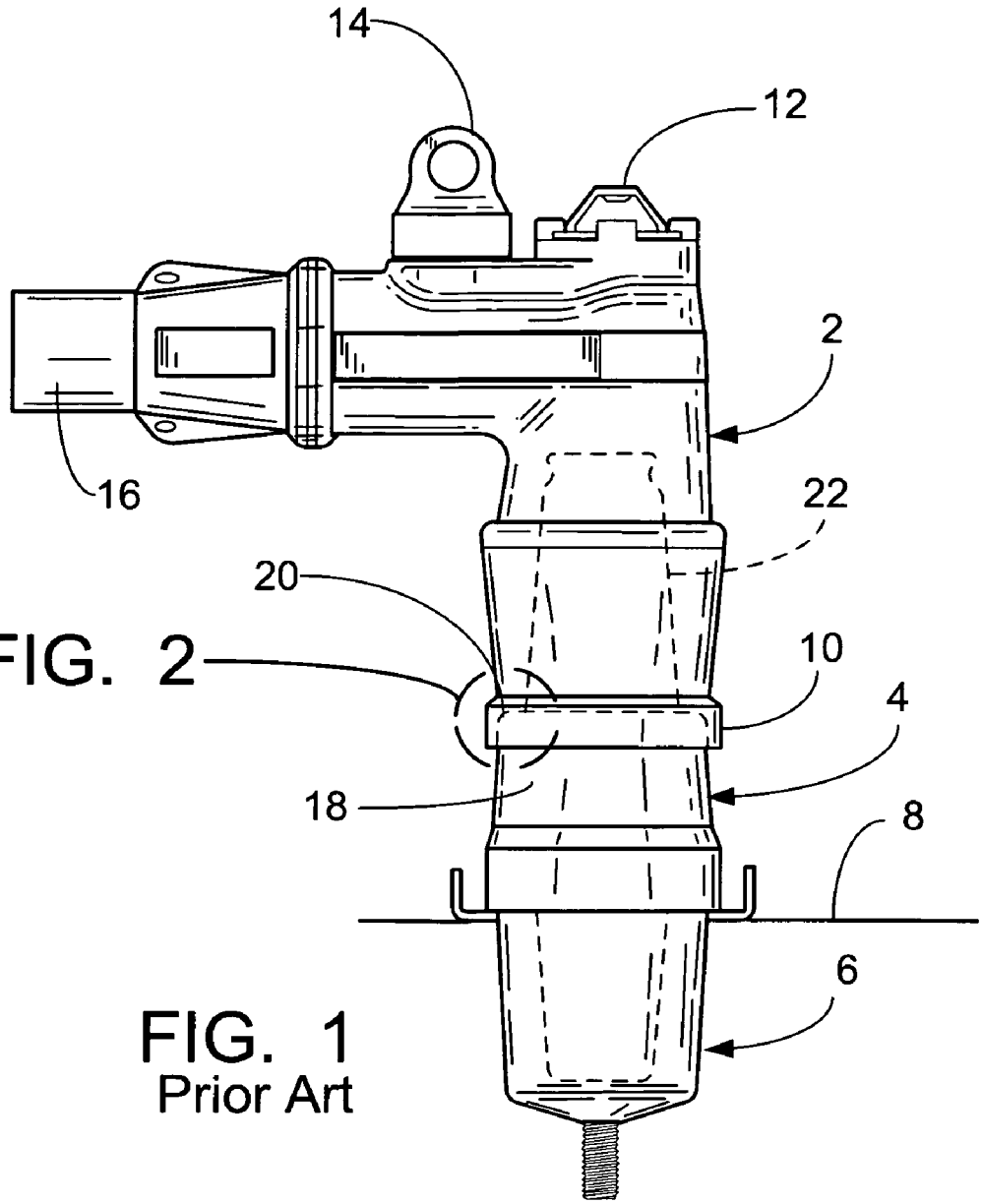
FIG. 2
FIG. 1
Prior Art
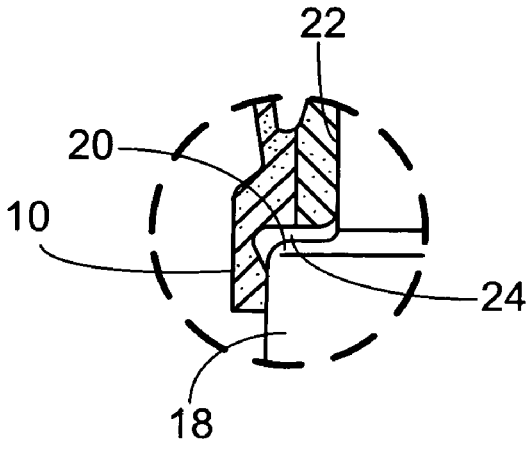
FIG. 2
Prior Art

FLAP SEATING INDICATOR

This application claims priority from provisional application Ser. No. 60/879,298, filed on Jan. 8, 2007, which is incorporated herein in its entirety.

FIELD OF THE INVENTION

The present invention relates to seating indicators for separable electrical connectors, and in particular, a flap seating indicator for separable electrical connectors such as loadbreak connectors and deadbreak connectors.

BACKGROUND OF INVENTION

Loadbreak connectors used with 15, 25 and 35 KV switchgear generally include a power cable elbow connector having one end adapted for receiving a power cable and another end adapted for receiving a loadbreak bushing insert. The end adapted for receiving the bushing insert generally includes an elbow cuff for providing an interference fit with a molded flange on the bushing insert. This interference fit between the elbow cuff and the bushing insert provides a moisture and dust seal therebetween.

An indicator band may be provided on a portion of the loadbreak bushing insert so that an inspector can quickly visually determine proper assembly of the elbow cuff and the bushing insert. Because of the high voltages, the indicator band has to be visible from a distance of 8-10 feet or more. Oftentimes, these indicator bands are not easily viewed and it is difficult to determine if a proper connection is made. Accordingly, there is a need for a seating indicator that can be easily viewed and that provides positive indication that a connection is properly made.

SUMMARY OF THE INVENTION

In accordance with the present invention, flap seating indicators for loadbreak and deadbreak connectors are provided. In a first embodiment, the seating indicator includes a substantially round ring-shaped body and a plurality of flaps. The body has a circumference, an exterior surface on the outside of the ring-shaped body, an interior surface on the inside of the ring-shaped body and two opposing side edges. The flaps are located around the circumference of the ring-shaped body and extend from one of the side edges. Each of the plurality of flaps has first and second sections that are pivotably connected. The first section attaches to the body and the second section has an indicating surface. The ring-shaped body is attached to an inner surface of an elbow cuff lip on an elbow connector. The exterior surface can be substantially flat so that it snugly fits into the elbow connector. When a bushing insert is properly inserted into the elbow connector, the second section of each of the plurality of flaps pivots so that the indicating surfaces of the flaps face the elbow connector. Preferably, the second sections of the flaps are substantially perpendicular to the first sections.

The indicating surfaces of the flaps have a highly visible color so that they are visible from at least a distance of five feet and preferably more than ten feet. In a one embodiment, each of the plurality of flaps has a width and the distance between any two flaps is less than or equal to the width. Locating the flaps closer together increases the visibility of the flaps. Preferably, the ring-shaped body and flaps are made of nylon, a hard plastic or a hard elastomeric material. In a preferred embodiment, each of the plurality of flaps has first and second ends that correspond to the first and second sections. Each flap has a first width where the two sections are pivotably connected and a second width at the second end. The second width is greater than the first width to increase the visibility when the flaps extend radially outwardly from the surface of the elbow connector.

In a second embodiment, the seating indicator includes a band having top and bottom surfaces and first and second sides; a plurality of members extending outwardly from the first side, wherein each of the plurality of members has an end; and a plurality of flaps pivotably mounted to the ends of the plurality of members, wherein each of the flaps has an indicating surface. The band is attached to a bushing insert and proper insertion of the bushing insert into an elbow connector pivots the flaps so that the indicating surfaces of the flaps face the elbow connector. Preferably, proper insertion of the bushing insert into the elbow connector pivots the flaps so that they are substantially perpendicular to the exterior surface of the elbow connector.

The indicating surfaces of the flaps have a highly visible color so that they can be viewed from a distance of at least five feet and preferably from a distance of more than ten feet. Each of the plurality of flaps has a width and, preferably, the distance between any two flaps is less than or equal to the width. The band, members and flaps of the seating indicator can be made of nylon, a hard plastic or a hard elastomeric material that is durable and substantially weather resistant.

In one embodiment, each of the plurality of flaps has a first end having a first width and a second end having a second width, wherein the second width is greater than the first width. When the bushing insert is properly inserted into the elbow connector, the second end of each of the flaps extends away from the exterior surface of the elbow connector so that the indicating surface is visible.

BRIEF DESCRIPTION OF THE FIGURES

The preferred embodiments of the flap seating indicator of the present invention, as well as other objects, features and advantages of this invention, will be apparent from the following detailed description, which is to be read in conjunction with the accompanying drawings wherein:

FIG. 1 is a side elevation view of prior art loadbreak connectors, namely, a power cable elbow, a loadbreak bushing insert and a universal bushing well;

FIG. 2 is an enlarged cross-sectional view of the mating interface between the prior art power cable elbow and loadbreak bushing insert illustrated in FIG. 1;

DETAILED DESCRIPTION OF THE INVENTION

Figure 3:
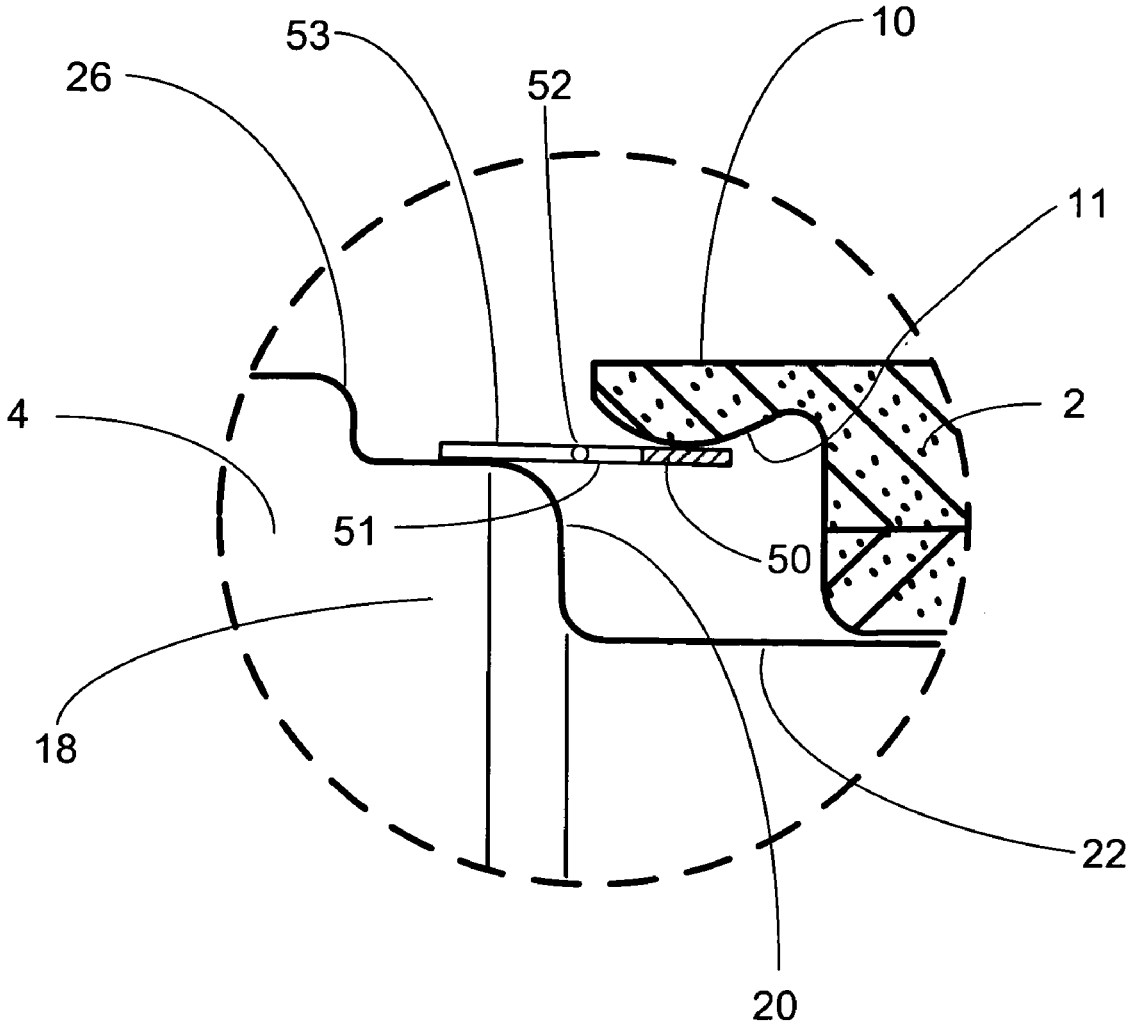
FIG. 3 is an enlarged cross-sectional view of the interface between the power cable elbow connector and a modified loadbreak bushing insert prior to mating, including a first embodiment of the flap seating indicator attached to the lip on the elbow cuff and formed in accordance with the present invention.

The flap seating indicators of the present invention are used on load break and deadbreak connectors, in particular, load break connectors as described in U.S. Pat. No. 5,795,180 to Siebens; U.S. Pat. No. 6,168,447 to Stepniak; and U.S. Pat. No. 7,044,760 to Borgstrom, et al., all of which are incorporated herein in their entirety.

The flap seating indicators are located at the connection point between a bushing insert and elbow connector and they provide visual verification that the connection has been properly made. A successful connection of a bushing insert and an elbow connector causes the indicating flaps to extend upwardly from the surfaces of the bushing insert and elbow connector so that they are clearly visible to a user. The indicating surfaces are brightly colored so that the flaps are highly visible and can be viewed by a user from a safe distance. The preferred colors are yellow and orange, although the invention is no way limited by the color of the indicating flaps. The bright colors allow a user to stand 8-10 feet or more away from the assembly and still easily view the indicating flaps, even when viewed from a generally longitudinal direction with respect to the connector. This is important because of the high voltages that are conducted through the connectors and the potential danger to a user if he or she cannot easily see the indicating flaps from a distance to verify that the elbow connector and bushing insert have been properly connected.

In a first embodiment, the flap seating indicator includes a substantially round ring-shaped body with a plurality of indicating flaps located around the circumference of the ring and extending from one of the side edges. Each of the flaps includes first and second sections that are pivotably connected. The first section attaches to the side edge of the body and the second section has an indicating surface. The ring-shaped body is attached to an inner surface of an elbow cuff lip on an elbow connector. When a bushing insert is properly inserted into the elbow connector, the second sections of flaps pivot so that the indicating surfaces of the flaps face the elbow connector.

In a second embodiment, the flap seating indicator includes a substantially round ring-shaped body having a plurality of members wherein each member has a first end extending from one of the side edges of the body and a second end pivotably connected to a flap with an indicating surface. The indicating surfaces of the flaps face away from the ring-shaped body and are downwardly biased towards the center of the ring-shaped body. The connecting end of a bushing insert passes through the flap seating indicator and the ring-shaped body snugly fits onto the mid-section of the bushing insert. When an elbow connector is properly connected to the bushing insert, the elbow cuff pushes against the indicating flaps until they are substantially perpendicular to the surface of the bushing insert. In this configuration, the indicating surfaces of the flaps are clearly visible from the direction of the elbow connector. This provides visible indication to a user that the elbow connector is properly connected to the bushing insert.

Referring now to the drawings, FIGS. 1 and 2 illustrate prior art loadbreak connectors. In FIG. 1, a power cable elbow connector 2 is illustrated coupled to a loadbreak bushing insert 4, which is seated in a universal bushing well 6. The bushing well 6 is seated on an apparatus face plate 8. The power cable elbow connector 2 includes a first end adapted for receiving the tapered upper section 22 of a loadbreak bushing insert 4 and having a flange or elbow cuff 10 surrounding the open receiving end thereof. The power cable elbow connector 2 also includes an operating eye 12 for providing "hot-stick" operation (i.e., operating when the connector is under a load) and a test point 14 which is a capacitively coupled terminal used with appropriate voltage sensing devices. A power cable receiving end 16 is provided at the opposite end of the power cable elbow connector 2 and a conductive member extends from the receiving end to the bushing insert receiving end for connection to a probe insertion end of the bushing insert 4.

Referring still to FIGS. 1 and 2, the loadbreak bushing insert 4 includes a mid-section 18 having a larger dimension than the remainder of the bushing insert 4. The mid-section 18 includes a transition shoulder portion 20 between the mid-section and an upper section 22 which is inserted into the power cable elbow connector 2. As more clearly illustrated in FIG. 2, which is an enlarged cross-section of the connector interface, the elbow cuff 10 and side portion of the mid-section for the bushing insert 4 provides a moisture and dust seal through an interference fit therebetween.

FIG. 3 is an enlarged cross-sectional view of the transition shoulder portion 20 of FIG. 1 and it shows a first embodiment of the present invention. FIG. 3 shows the interface between the mid-section 18 of a modified loadbreak bushing insert 4 and the elbow cuff 10 of a power cable elbow connector 2 prior to mating, wherein elbow cuff 10 passes over the upper section 22 of the bushing insert 4. The ring-shaped body 50 of the flap seating indicator is attached to the inner lip 11 of the elbow cuff 10. The flap seating indicator includes the ring-shaped body 50 and a plurality of flaps 51 (FIG. 4A) extending from and circumferentially spaced around the side of the ring-shaped body 50. Each seating indicator flap 51 is articulated by a pivot point 52 near the middle and has an indicating surface 53. FIG. 3 shows the seating indicator flap 51 in an unactuated or fully extended position as it passes over the transition shoulder portion 20 of the bushing insert 4.

Figure 4:
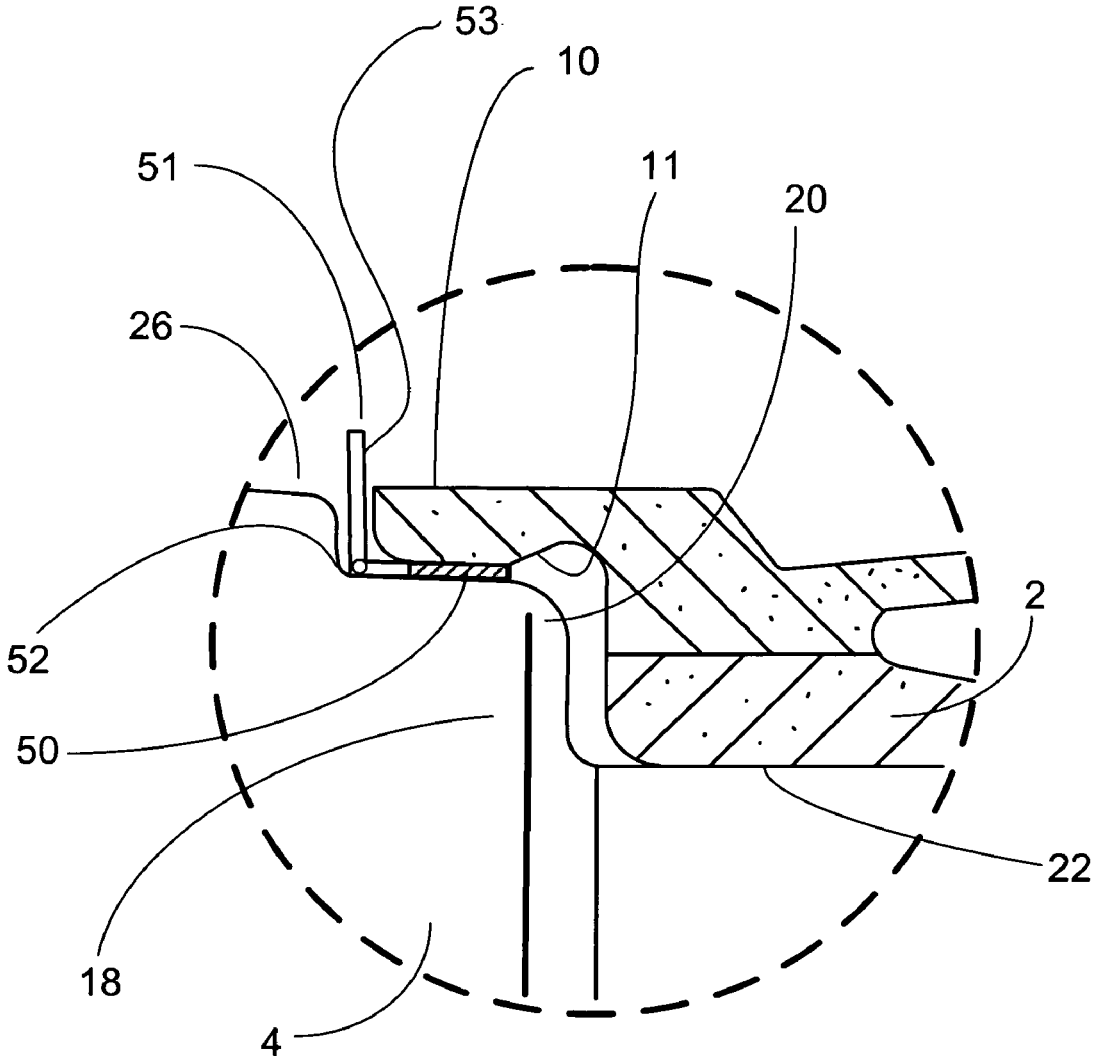
FIG. 4 is an enlarged cross-sectional view of the mating interface between the power cable elbow connector and a modified loadbreak bushing insert with a step, including a first embodiment of the flap seating indicator attached to the lip on the elbow cuff.
Figure 4A:
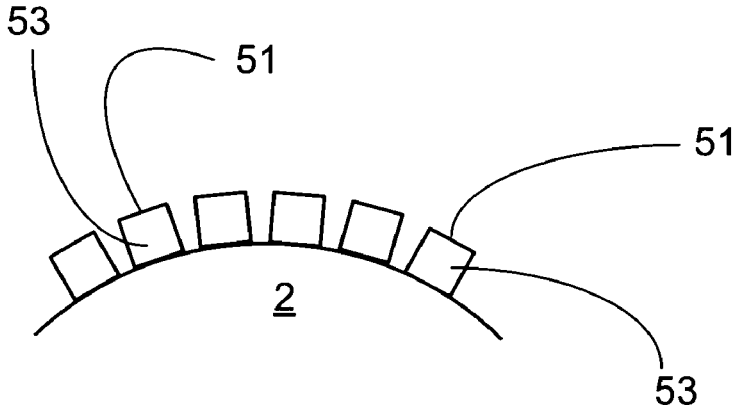
FIG. 4A is a view along the longitudinal axis of the connector of the indicating flaps when the cable elbow and loadbreak bushing insert are connected.

FIG. 4 shows the mating interface between the elbow cuff 10 of the power cable elbow connector 2 and a modified loadbreak bushing insert 4 with a step 26 near the mid-section 18. When the upper section 22 of the bushing 4 is inserted into the elbow connector 2, the step 26 opposes the plurality of seating indicator flaps 51 and directs the flaps 51 radially upwardly and away from the connection interface as shown in FIGS. 4 and 4A. The indicating surfaces 53 of the seating indicator flaps 51 face the elbow connector 2 and preferably have a bright color that is highly visible, such as yellow or orange. This allows a user to view the seating indicator flaps 51 from a distance of more than 8 feet, even when viewed from a generally longitudinal direction with respect to the connector.

Figure 5:
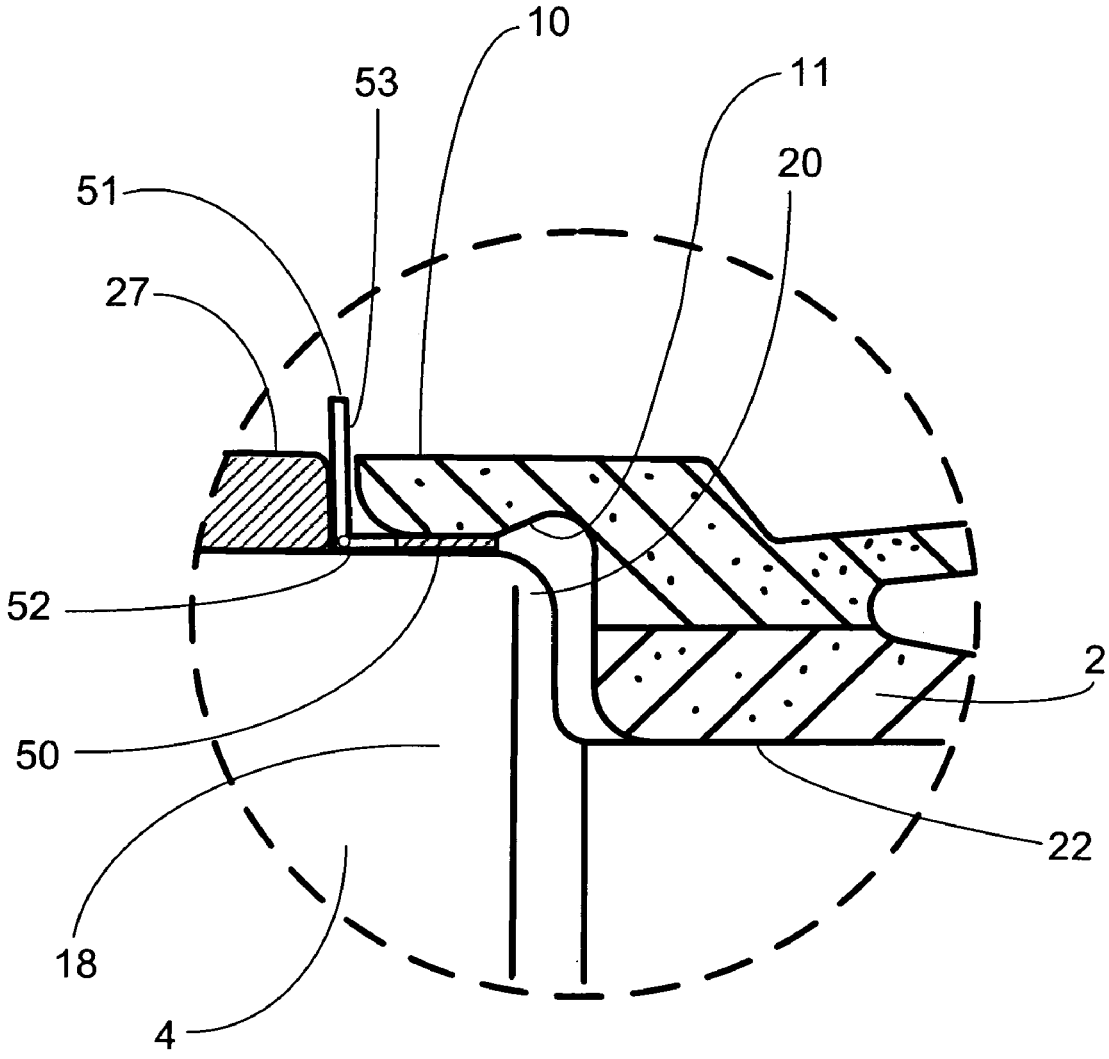
FIG. 5 is an enlarged cross-sectional view of the mating interface between the power cable elbow connector and a modified loadbreak bushing insert with a collar on the bushing insert to create a step, including a first embodiment of the flap seating indicator attached to the lip on the elbow cuff.
Figure 5A:
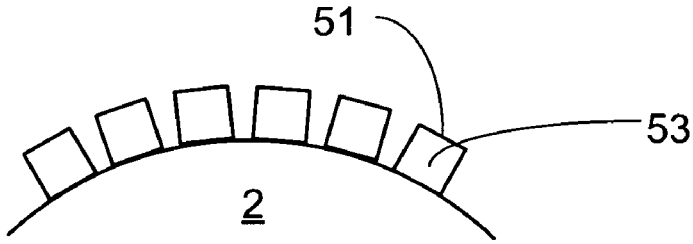
FIG. 5A is a view along the longitudinal axis of the connector of the indicating flaps when the cable elbow and loadbreak bushing insert are connected.

FIG. 5 shows the interface between the elbow cuff 10 of the power cable elbow connector 2 and the mid-section 18 of a modified loadbreak bushing insert 4, wherein a collar 27 is attached around the mid-section 18 of the bushing insert 4 to oppose the seating indicator flaps 51. When the upper section 22 of the bushing insert 4 is inserted into the elbow connector 2, the collar 27 opposes the seating indicator flaps 51 and directs the plurality of flaps 51 radially upwardly as shown in FIGS. 5 and 5A. The colored sides 53 of the flaps 51 indicate to the user that the elbow connector 2 has been properly connected to the bushing insert 4.

Figure 6:
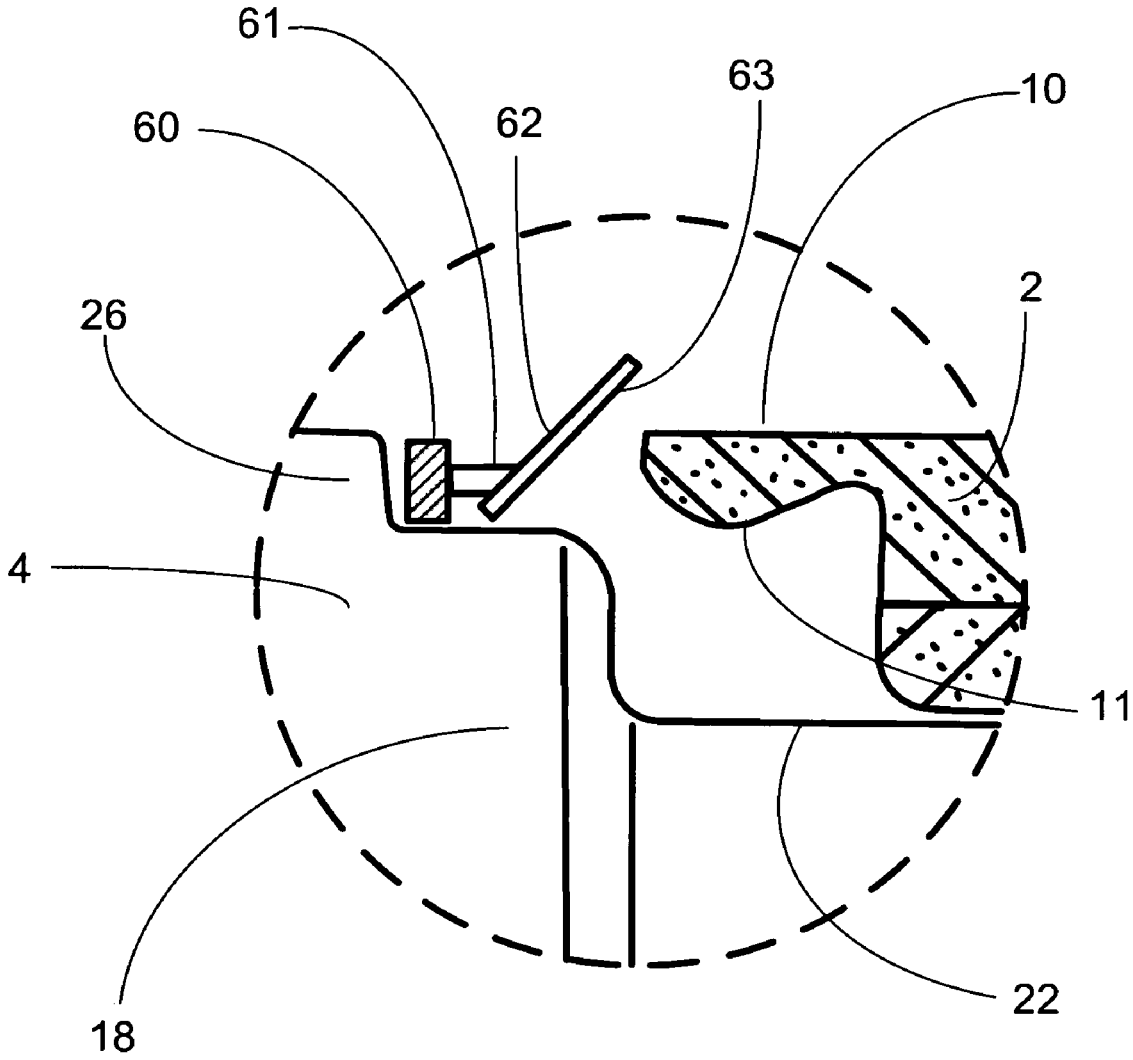
FIG. 6 is an enlarged cross-sectional view of the interface between the power cable elbow connector and a modified loadbreak bushing insert prior to mating, including a second embodiment of the flap seating indicator attached to a ring on the bushing insert.

FIG. 6 is an enlarged cross-sectional view of the transition shoulder portion 20 of FIG. 1 and it shows a second embodiment of the flap seating indicator. FIG. 6 shows the interface between the elbow cuff 10 of the power cable elbow connector 2 and a modified loadbreak bushing insert 4 prior to mating. The flap seating indicator includes a substantially round, ring-shaped body 60, a plurality of members 61 and a plurality of seating indicator flaps 62. The members 61 are located around the circumference of the body 60 and extend laterally from one side of the body 60. Each member 61 is connected to the body 60 on one end and pivotably attached to a seating indicator flap 62 on the opposing end. Each of the seating indicator flaps 62 has an indicating surface 63 that faces away from the body 60 and that is downwardly biased which keeps the indicating surface 63 facing downwardly towards the bushing insert 4 in the unactuated or unconnected position.

Figure 7:
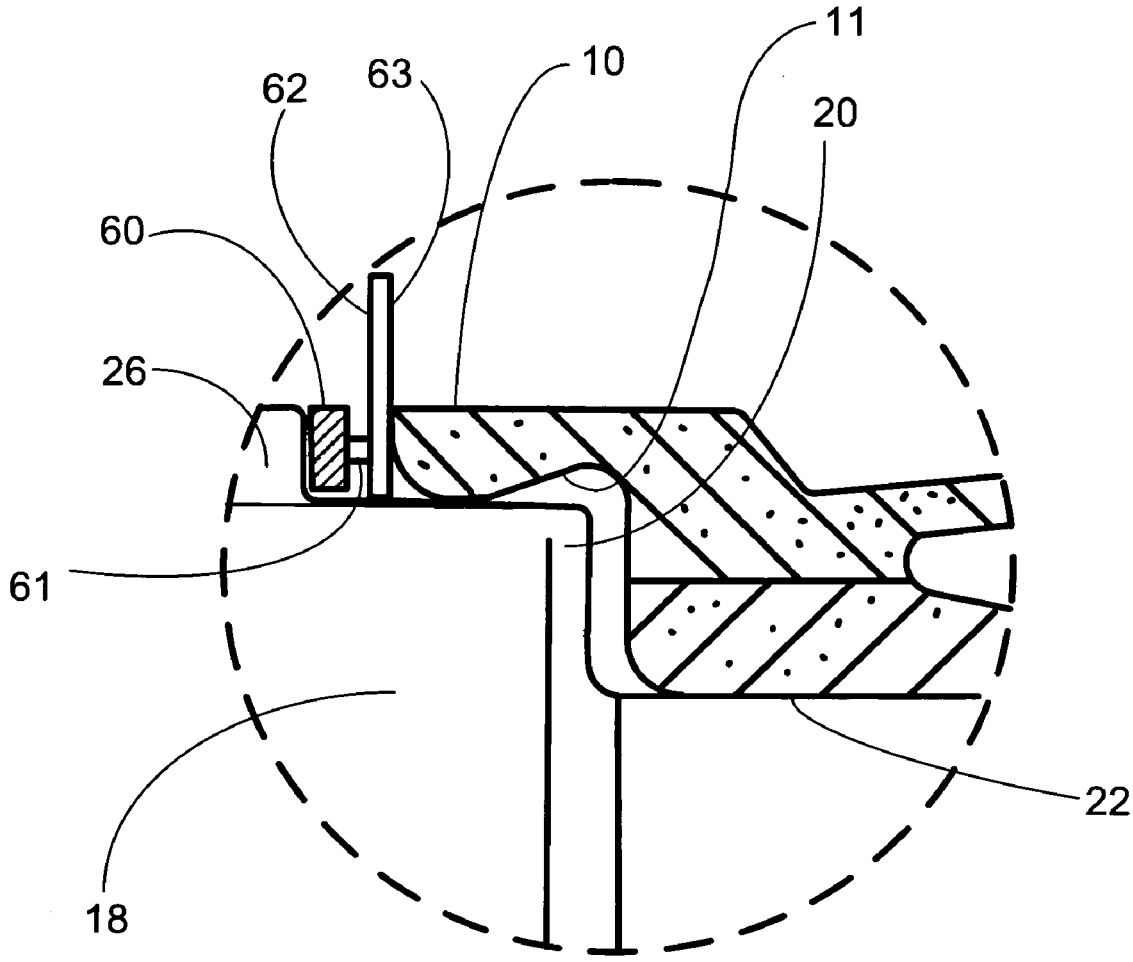
FIG. 7 is an enlarged cross-sectional view of the mating interface between the power cable elbow connector and a modified loadbreak bushing insert with a step, including a second embodiment of the flap seating indicator having a ring-shaped body and a plurality of flaps attached to the bushing insert.
Figure 7A:
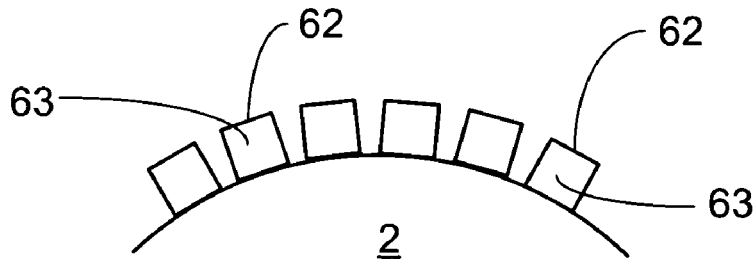
FIG. 7A is a view along the longitudinal axis of the connector of the indicating flaps when the cable elbow and loadbreak bushing insert are connected.

FIG. 7 shows the mating interface between the elbow cuff 10 of the power cable elbow connector 2 and a modified loadbreak bushing insert 4 with a step 26 near the mid-section 18. When the upper section 22 of the bushing 4 is inserted into the elbow connector 2, the elbow cuff 10 contacts the plurality of flaps 62 of the seating indicator and directs the flaps 62 upwardly as shown in FIGS. 7 and 7A. The indicating surface 63 on the sides of the flaps 62 facing the elbow connector 2, preferably have a bright color that is highly visible, such as yellow or orange. This allows a user to view the indicating surface 63 of the flap seating indicator from a distance of more than 8 feet, even when viewed from a generally longitudinal direction with respect to the connector.

Figure 8:
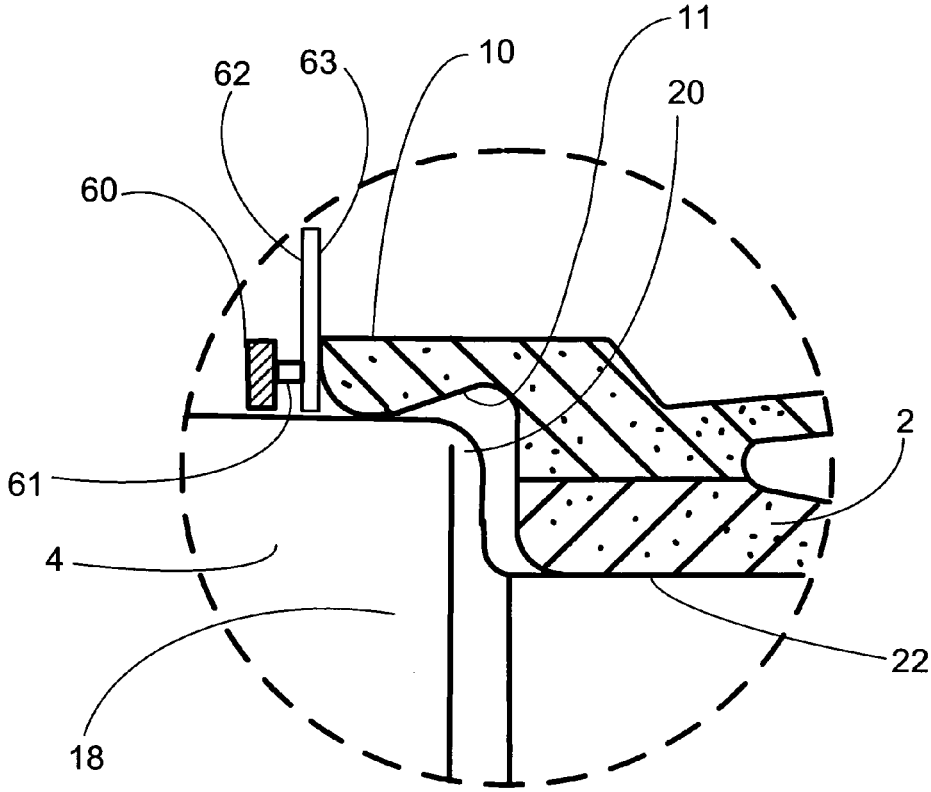
FIG. 8 is an enlarged cross-sectional view of the mating interface between the power cable elbow connector and a modified loadbreak bushing insert, including a second embodiment of the flap seating indicator having a ring-shaped body and a plurality of flaps attached to the bushing insert.
Figure 8A:
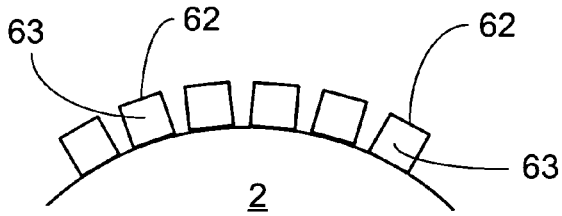
FIG. 8A shows substantially rectangular flap seating indicators viewed along the longitudinal axis of the connector of the indicating flaps when the cable elbow and loadbreak bushing insert are connected.
Figure 8B:
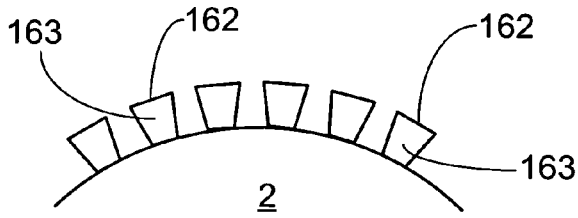
FIG. 8B shows flap seating indicators with tapered sides viewed along the longitudinal axis of the connector of the indicating flaps when the cable elbow and loadbreak bushing insert are connected.

FIG. 8 shows the interface between the power cable elbow connector 2 and a modified loadbreak bushing insert 4 without the step shown in FIG. 7. The body 60 of the flap seating indicator is attached around the mid-section 18 of the bushing insert 4. When the upper section 22 of the bushing 4 is inserted into the elbow connector 2, the elbow cuff 10 contacts the plurality of flaps 62 and directs the flaps 62 radially upwardly as shown in FIGS. 8 and 8A. The brightly colored indicating surfaces 63 of the flaps 61 indicate to the user that the elbow connector 2 has been properly connected to the bushing insert 4. FIG. 8B shows an embodiment of the present invention in which the end of each flap 162 has a greater width than the base of the flap 162. This provides an increased surface area for the indicating surfaces 163 of the flaps 162.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A seating indicator for a loadbreak connector or a deadbreak connector, the seating indicator comprising:

a substantially round ring-shaped body having a circumference, an exterior surface on the outside of the body, an interior surface on the inside of the body and two opposing side edges; and a plurality of flaps located around the circumference of the body and extending from one of the side edges, wherein each of the plurality of flaps comprises first and second sections that are pivotably connected, wherein the first section attaches to the body and the second section has an indicating surface, wherein the body is attached to an inner surface of an elbow cuff lip on an elbow connector, and wherein proper insertion of a bushing insert into the elbow connector pivots the second section of the plurality of flaps so that the indicating surface of the flaps face the elbow connector.

2. The seating indicator in accordance with claim 1, wherein the exterior surface is substantially flat.

3. The seating indicator in accordance with claim 1, wherein the proper insertion of a bushing insert into the elbow connector pivots the second section of the plurality of flaps so that the second section is substantially perpendicular to the first section.

4. The seating indicator in accordance with claim 1, wherein the indicating surface of the flaps have a highly visible color.

5. The seating indicator in accordance with claim 1, wherein each of the plurality of flaps has a width, and wherein the distance between any two flaps is less than or equal to the width.

6. The seating indicator in accordance with claim 1, wherein the body and flaps are made of nylon, a hard plastic or a hard elastomeric material.

7. The seating indicator in accordance with claim 1, wherein each of the plurality of flaps has first and second ends that correspond to the first and second sections, wherein each of the plurality of flaps has a first width where the two sections are pivotably connected and a second width at the second end, and wherein the second width is greater than the first width.

8. A seating indicator for a loadbreak connector or a deadbreak connector, the seating indicator comprising:

a band having top and bottom surfaces and first and second sides;

a plurality of members extending outwardly from the first side, wherein each of the plurality of members has an end; and a plurality of flaps pivotably mounted to the ends of the plurality of members, wherein each of the flaps has an indicating surface, wherein the band is attached to a bushing insert, and wherein proper insertion of the bushing insert into an elbow connector pivots the flaps so that the indicating surfaces of the flaps face the elbow connector.

9. The seating indicator in accordance with claim 8, wherein the elbow connector has an exterior surface and wherein the proper insertion of the bushing insert into the elbow connector pivots the plurality of flaps so that the flaps are substantially perpendicular to the exterior surface.

10. The seating indicator in accordance with claim 8, wherein the indicating surface of the flaps have a highly visible color.

11. The seating indicator in accordance with claim 8, wherein each of the plurality of flaps has a width, and wherein the distance between any two flaps is less than or equal to the width.

12. The seating indicator in accordance with claim 8, wherein the band, members and flaps are made of nylon, a hard plastic or a hard elastomeric material.

13. The seating indicator in accordance with claim 8, wherein each of the plurality of flaps has a first end having a first width and a second end having a second width, wherein the elbow connector has an exterior surface, wherein the second end of each of the flaps extends away from the exterior surface when the bushing insert is properly inserted into the elbow connector, and wherein the second width is greater than the first width.

* * * * *